United States Patent [19]

Allen

[11] Patent Number: 4,480,519

[45] Date of Patent: Nov. 6, 1984

[54] MUSICAL INSTRUMENT WITH IMPROVED KEYBOARD

[75] Inventor: Maria R. Allen, Washington, D.C.

[73] Assignee: Yolanda M. Arellano, Washington, D.C.

[21] Appl. No.: 429,364

[22] Filed: Sep. 30, 1982

[51] Int. Cl.[3] ..... G10H 1/22

[52] U.S. Cl. ..... 84/1.01; 84/423 A; 84/451; 84/DIG. 2

[58] Field of Search ..... 84/1.01, 423 R, 423 A, 84/423 B, 451, DIG. 2, DIG. 7, DIG. 8, DIG. 20

[56] References Cited

U.S. PATENT DOCUMENTS

| | | | |
|---|---|---|---|
| 1,685,401 | 9/1928 | Fellows | 84/451 |
| 2,456,575 | 12/1948 | Young | 84/451 X |
| 2,706,926 | 4/1955 | Young | 84/451 |
| 3,200,689 | 8/1965 | Rosberger | 84/451 X |
| 3,943,811 | 3/1976 | Coles | 84/1.01 |
| 3,986,422 | 10/1976 | Coles | 84/1.01 |
| 4,009,633 | 3/1977 | Coles | 84/1.01 |
| 4,048,893 | 9/1977 | Coles | 84/1.01 |
| 4,098,162 | 7/1978 | Okamoto et al. | 84/1.01 |
| 4,100,831 | 7/1978 | Deutsch | 84/1.01 |

OTHER PUBLICATIONS

Osvaldo Skliar et al., "Una Nueva Notacion Musical", *Editorial Episteme* (Buenos Aires 1976).

*Primary Examiner*—S. J. Witkowski

*Attorney, Agent, or Firm*—Pollock, Vande Sande & Priddy

[57] ABSTRACT

An improved keyboard for a musical instrument includes a plurality of keys arranged in a side-by-side order, all lying in a common plane. Different embodiments of the invention have a varying number of keys per octave, from as small as 12 keys per octave to as high as 90–120 keys per octave. In those embodiments of the invention in which the number of keys per octave results in a key whose width is too narrow to be uniquely depressed by an operator's finger, associated apparatus determines from a plurality of keys which have been depressed, a particular tone to be produced. The keyboard may be associated with apparatus to distinguish one set of keys from other sets of keys, which apparatus can include a selectively energizable light source associated with each different key or other equivalent apparatus.

10 Claims, 21 Drawing Figures

FIG. 11 SOUND # VS. MODE
| KEY | FIRST | SECOND | ALTERNATE |
|---|---|---|---|
| 210 | 0 | 5 | NULL |
| 211 | 1 | 5 | NULL |
| 212 | 2 | 5 | NULL |
| 213 | 3 | 5 | 5 |
| 214 | 4 | 5 | NULL |
| 215 | 5 | 5 | NULL |
| 216 | 6 | 6 | NULL |
| ⋮ | ⋮ | ⋮ | ⋮ |
| 220 | 20 | 25 | NULL |
| 221 | 21 | 25 | NULL |
| 222 | 22 | 25 | NULL |
| 223 | 23 | 25 | 25 |
| 224 | 24 | 25 | NULL |
| 225 | 25 | 25 | NULL |
| 226 | 26 | 30 | NULL |
FIG. 12 _ A MAJOR SCALE
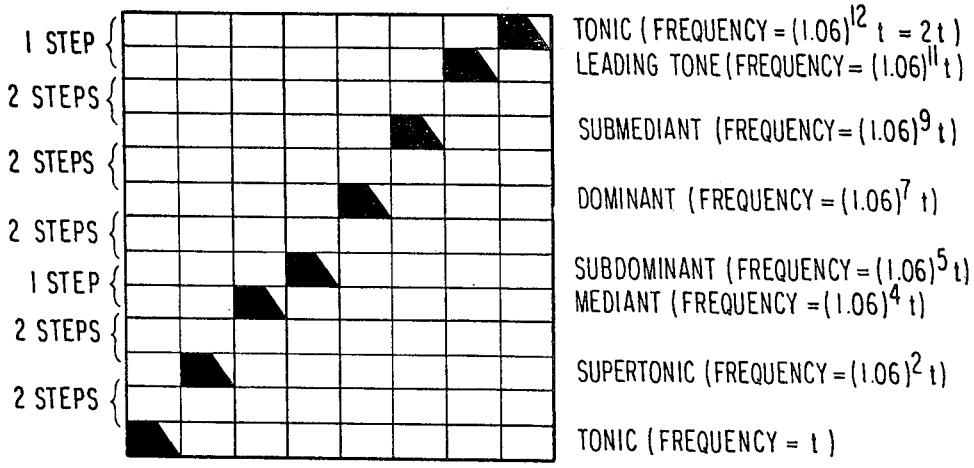

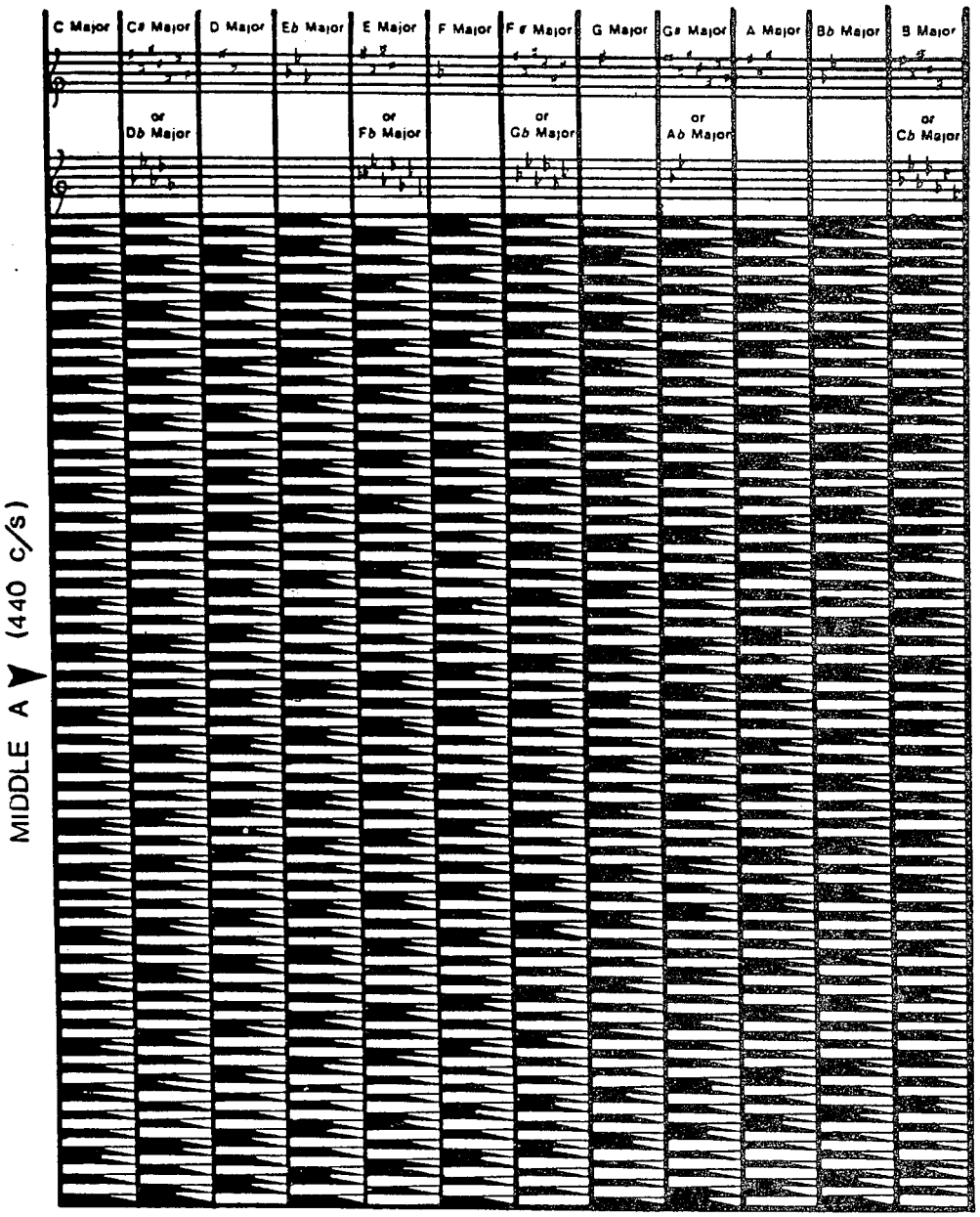
FIG. 13 MAJOR TONALITIES: SOUNDS THAT BELONG TO THEIR SCALES.

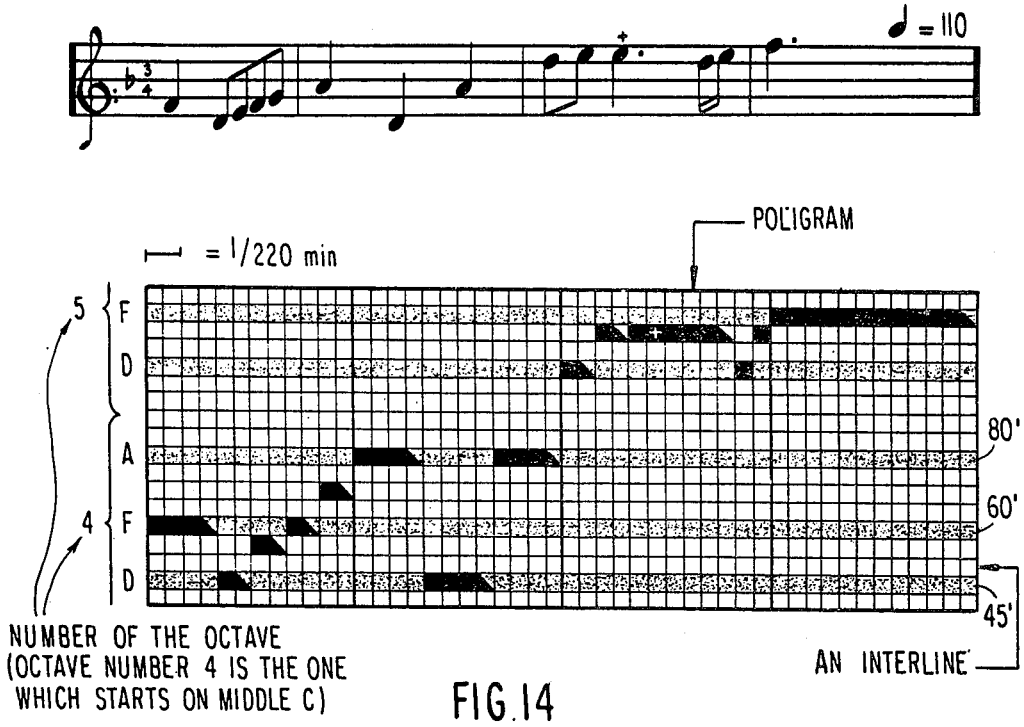
FIG.14
FIG.15A
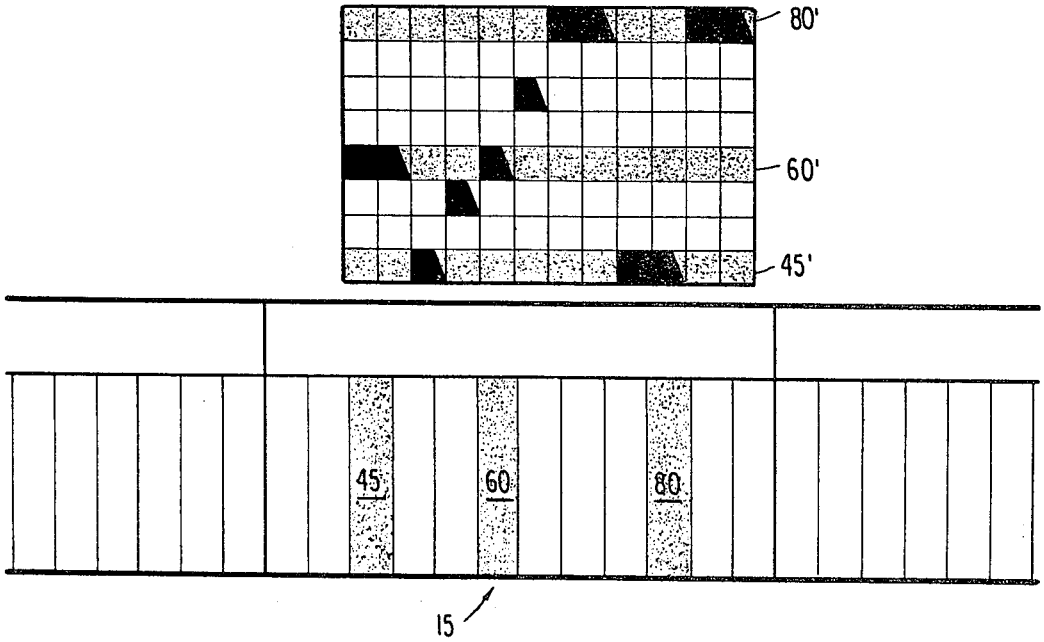

MUSICAL INSTRUMENT WITH IMPROVED KEYBOARD

DESCRIPTION

Technical Field

The invention relates to instruments for the production of music, and more particularly to improved keyboard components and methods of use.

Related Disclosure Document

This application is related to Disclosure Document No. 108,729 filed June 3, 1982, entitled "Cartesian Musical Notation System".

BACKGROUND

The raw material in making music are sounds. While the term sound covers a host of characteristics, in this application the particular characteristic of the sounds which are produced, which is varied or controlled is the frequency. Thus, when sound is used herein the characteristic that is controlled or selected is its frequency. Man can in general hear sounds with frequency range between 15 and 24,000 hertz, the frequency of sounds which musicians use lie in the smaller range of about 20 to 10,000 hertz. Occasionally other sounds are used in music, for example certain huge organs can produce sounds with frequencies in the vicinity of 16,000 hertz. However, while humans can hear sounds within the large range mentioned above, they cannot distinguish between two sounds when their frequencies are too close together. The arrangement of sounds in the ascending order of their frequencies which can be separately distinguished is a set of different sounds which comes to a total of about 2,000. In Occidental music, musicians use a much smaller number of sounds, for example 110 sounds in the range 21.8 hertz to 10,548 hertz, where each sound or tone has a frequency with a ratio of 1.06 to the next adjacent lower tone or sound. Sounds whose frequencies have the ratio $1:2^n$ (where n is an integer) have so many identical characteristics that they are sometimes referred to as the "same" sound.

Sounds with this frequency ratio are usually separated by an interval of 12 different sounds in the set of 110 sounds mentioned above. For this reason, we commonly refer to the entire set of 110 different sounds as if there are only 12, using only 12 different names over and over again.

Thus, in Occidental music as well as music of other cultures, there is a reduction of the available raw material employed which is connected with the election of a given set of sounds. For purposes of description, we will call such smaller sets of sounds which musicians specially choose to use, Politones; and the sounds which belong to them are tones.

Examples of different Politones are the Great Perfect Systems and the Lesser Perfect Systems of ancient Greek music, the Equal Temperament, the Pure or Just Temperament and the Mean Tone Temperaments of Occidental music, etc. Since the reduction of the available raw material to a given Politone is not arbitrary, but well grounded in underlying acoustical relationships among its tones, the specific reduction is, to a great extent, responsible for the principle characteristics and development of the music which uses that particular Politone.

Some instruments, like the human voice, violas, violins, etc., are readily capable of playing music in any given Politone because they are able to produce a continuous set of sounds. Other instruments, for example the piano, harp and Kithara, can be tuned to produce the tones of different Politones. Still other instruments, like flutes, horns, etc., are much less flexible and are generally made to produce the tones of a given Politone.

Even with the most flexible of instruments, it is difficult to play in Politones of different cultures when these Politones have a larger number of tones spaced at smaller intervals. In such cases, it is not easy to recognize such small intervals by ear, and accordingly to find those tones in continuous instruments. Sometimes it is necessary to use an acoustical device to tune an instrument, like the harp, to give tones of a desired Politone. Once a Politone is familiar to use, we can sing it or play it on continuous instruments. Similarly, it is difficult to play music in Politones used a long time ago even in our own culture (the irregular tunings used during the 18th century or the various shades of Mean Tone temperament, etc.). For this reason, accurate examples of music of different cultures and epochs are generally not available to the public at large or even students of music. Sometimes a composer who wants to experiment with a new Politone may have to build up a novel instrument for that Politone itself.

As a result of the relatively new capability of synthesizing sounds by electronic means, it is now possible to produce sounds of any desired pitch (frequency). However, notwithstanding this significant flexibility, electronic musical instruments still use the traditional keyboard with its configuration of black and white keys which is related to the use of a particular Politone (i.e. the Equal Temperament) and some others which are very similar to it. For example, when teachers and composers want to use a Politone containing 32 tones equally spaced within each octave, each octave is spanned by 32 traditional keys, which is rather inconvenient because the number of octaves that the keyboard can accommodate is then severely reduced. Also the particular configuration of white and black keys is, in this case, not only of no use, but is actually a hindrance. Likewise, when the intervals between the tones are not equal, there is no way of visually displaying that difference on the keyboard. Even in the equal tempered system, the traditional keyboard does not display the intervals between different sounds. An additional constraint of the traditional keyboard is the inability to produce portamento and vibrato which are cherished techniques of musical expression.

In Occidental music, there is usually a further reduction in the raw material of sounds employed which is connected with the election of a given tonality. The election of a given tonality by a composer is an indication to a predisposition to give a particular sound, which is called a tonic, a conspicuous role in the piece by means of using mostly a subset of sounds which are in deep connection with a tonic. With such a subset, it is possible to emphasize, reinforce, announce or simply suggest the presence of the tonic.

A scale is the arrangement, in ascending order of frequencies, of the tonic along with the subset of sounds which are in deep connection with the tonic. Since tonalities can be major or minor (major tonalities are described as affirmative and optimistic, minor tonalities as inquisitive and melancholy) there are major and minor scales. Any major scale for instance has seven sounds, the role names of these sounds and the size of intervals between them are shown in FIG. 12. Since 12 different sounds can be taken as a tonic we therefore have 12 different major scales. As shown in FIG. 13, the election of a given tonality produces a division of the whole set of sounds into two subsets, the subset of those that belong to the scale that is being used and the subset of sounds that do not belong. This division does not mean that the election of a given tonality excludes the use of sounds outside the given scale, for with them it is possible to hide, camouflage, evade or make dissonant the presence of the tonic.

The nomenclature of sounds in traditional notation is based on the division which the election of the C major tonality imposes on the set of sounds. Traditional notation has a first class of names for the seven sounds which belong to the C major scale: in particular C, D, E, F, G, A and B; and a second class of names for the five sounds outside the C major scale (each of these sounds has two different names), e.g., C sharp—D flat, D sharp—E flat, F sharp—G flat, G sharp—A flat, A sharp—B flat. It is this same division which is imposed on the piano keyboard, the white keys correspond to the sounds of the C major scale and the black keys correspond to the sounds outside the scale.

When a major tonality is elected whose tonic is C, then it is very convenient that the 12 sounds in the octave are classified into two different groups according to their relation to the C major scale. However, this nomenclature which is so helpful and illustrative for the C major tonality is definitely obstructive for any other tonality, for it appears to suggest a division of the set of sounds that is not the one actually being used. Because the division is artificial in every case (except C major), it must constantly be rectified by using alterations (and reiterated alterations) which leads to a rather inelegant notational system creating not only several different names for the same sound but also purely notational phenomena such as the susceptibility of chords to various interpretations.

Moreover, traditional notation and traditional musical nomenclature are (not surprisingly) closely connected with the Politones that have been traditionally used in the Western culture during the last 300 years. Thus, this notation and nomenclature are also of little or no use to represent and describe structures of music which differ dramatically from the traditional ones.

I have developed a musical notation, see "Una Nueva Notacion Musical" by Skliar, et al., appearing in *Editorial Episteme* (Buenos Aires 1976) which provides a unity for the notation of all kinds of music and whose visual patterns are the natural counterpart of the aural patterns they represent. That notation will be briefly described here since a method of using my keyboard has important relationships to the notation. This description will start with an explanation of how to use it to notate music in equal temperament because it is the Politone most familiar to us, however it will be apparent how to use it to notate music in any desired Politone.

The notation which is described here is called Cartesian, because its basic feature is the representation of sounds in a Cartesian coordinate plane by means of their parameters of pitch (frequency) and duration. Pitch has been logarithmically represented, and both pitch and duration are represented as discrete magnitudes. (See FIG. 14). In order to notate a given composition in equal temperament, a grill work, called the poligram, like the one shown in FIG. 14 is used. The spaces between two parallel horizontal lines are called interlines. The poligram used in each case must have at least as many interlines as there are sounds spaced in semitones between (and including) the lowest and the highest sound of the composition. From bottom to top each interline belongs respectively to each one of those sounds arranged from the lowest to the highest. The correspondence between the tones of equal temperament and interlines is designated on the left side of the poligram as shown in FIG. 14. When the composition is written in a given tonality, the interlines which correspond to the sounds of the tonic chord of that tonality can be shaded, as also seen in the figure.

Each sound is represented by a trapezium (or indicium) placed in the corresponding interline. The length of the base of the trapezium shows the duration of the sound. Sounds of the smallest duration in the composition must be represented by a trapezium whose base covers the distance between two consecutive parallel vertical lines of the poligram. Sounds which are 2, 3, 4 times, etc. longer must be represented, respectively, by trapeziums whose bases extend over the distances between 2, 3, 4, etc. consecutive parallel vertical lines of the poligram. Vertical lines which correspond to the end of each measure may be highlighted in the poligram as also seen in the figure.

In the same way that the election of a given tonality is indicated by means of shading, those interlines which correspond to the sounds of the tonic chord, likewise, when a modal scale, a non-traditional tonality, or non-tonality is used, either the appropriate interlines can be shaded, or none at all. If a Politone other than equal temperament is used, as in microtonalism, or music of different cultures, the correspondence between tones and interlines is accordingly changed.

In Cartesian notation the size of intervals between the written sounds can be recognized immediately by the eye, just as the aural effect of the interval is recognized by the ear; to notate different transpositions of a given music score is as easy as it is to sing the represented music at different pitches. Finally, the notation enables any musical phenomenon to have a spatial counterpart within the poligram.

However, either with this or any other system of notation the piano keyboard, due to the artificial division between the tones associated with the C major scale, and all other tones, associates different configurations of keys with what are identical aural phenomena. Because the Equal Temperament is a regular tuning, each tone is no more or less important than any other tone. Accordingly the keyboard for playing or composing music should not suggest an artificial division between sounds, as is suggested by the piano keyboard or keyboards similar thereto.

As described in my co-pending application entitled "Linear Keyboard Adapter" filed Aug. 18, 1982, S.N. 409,250, and now abandoned a conventional piano keyboard has 88 keys, seven white keys and five black keys in each octave. Non-conventional pianos may have more or less than 88 keys, but each have the same the division of keys per octave. Other instruments (both those that produce music mechanically as well as the newer instruments which produce music electronically) may have more or less than 88 keys, but again the relationship of seven white keys and five black keys per octave is maintained. Throughout the remainder of this application, those keyboards will be referred to as a piano keyboard, regardless of whether or not the keyboard is part of a piano, so long as it has the conventional seven white keys and five black keys per octave.

Although this complement of seven white keys and five black keys per octave is traditional, there have been suggestions for alterations in this relationship. For example Coles in U.S. Pat. Nos. 3,845,685; 3,943,811; 3,973,460 and 3,986,422 suggest a keyboard which includes five white keys and at most five black keys per octave, or a total of a maximum ten keys per octave. On the other hand, other proposals (see House U.S. Pat. No. 2,097,280 and Young U.S. Pat. No. 2,706,926) suggest increasing the number of keys per octave. In the case of House, he suggests 18 keys per octave, six white keys, six long black keys and six short black keys. Young on the other hand, suggests 24 keys per octave, again using a combination of long and short keys, in three different tiers. The upper and lower tiers include seven keys, and the intermediate tier includes ten keys. Each of these keyboards is restricted to one or a few Politones, none are able to produce portamento or vibrato. All of the keyboards retain an uneven configuration of keys which has no correspondence with the intervals among the sounds which the keys produce.

SUMMARY OF THE INVENTION

Based on a host of factors, I believe that an improved keyboard can be produced which is significantly different both from the piano keyboard as well as from alterations suggested by Young and/or House. In particular, my improved keyboard is comprised of similar keys which are disposed in a planar arrangement, side by side in a linear order, the distance from a reference point on one key to a corresponding reference point on an adjacent key is proportional to the logarithm of the interval between the sounds which the keys produce. In this expression, "interval between sounds" means the ratio of their frequencies. Since keyboards are ordinarily read from left to right, the typical reference point on a key, for purposes of measuring and comparing the distance between reference points on adjacent keys is taken at the left edge of the key.

Accordingly, a common characteristic to all embodiments of the invention is that the keys are arranged in a planar arrangement (the upper surface of all the keys lies in a theoretical plane) and in a linear side by side order as opposed to the two or three different tiers of keys used in the piano keyboard and its alterations which are specifically referred to above. The number of keys within each octave can vary from one embodiment to the other, the size of the span encompassed by an octave in my keyboard (measured for example in inches) is identical (or at least nearly so) to the size of the span of an octave in a piano keyboard.

In one preferred embodiment of the invention (sometimes referred to as linear basic) the keyboard includes 12 identical keys per octave which produces the 12 identically spaced tones of equal temperament. Since the pitch interval between these keys is identical, the keys are also of identical width. The names of the sounds produced by each key is shown in FIG. 2 for a particular octave.

Another embodiment of the invention, which produces the tones of the Diatonic Just Intonational Politone, is shown in FIG. 17. FIG. 18 shows still another embodiment of the invention which provides the sounds of a Politone which has 30 tones equally spaced within each octave.

A second preferred embodiment of the invention, which is referred to as linear continuous or continuous for shorthand purposes, has a number of keys per octave which is increased dramatically above those mentioned above. The goal is to provide the linear continuous keyboard with a sufficient number of keys within each octave to provoke the illusion that any desired sound within an octave can be produced, i.e. to provoke the illusion of producing a continuous set of sounds. In my opinion, this calls for a minimum of about 90 to 120 keys per octave. However, since the achievement of the above-mentioned goal depends on the subjective judgment and ear training of the listener, there is no firm minimum number of keys per octave at which this goal can be said to be achieved. The actual size of the interval between sounds produced by adjacent keys is mainly a matter of cost; the smaller the interval, the greater the number of narrower keys within each octave. Since the optimum size of the span of each octave is dictated by human factors, in all forms of the invention it is similar to the size of the span of an octave on a piano keyboard. It is apparent then that in some embodiments of the invention, particularly in the linear continuous, the width of each key is significantly below the point at which it is possible for the human finger to selectively depress a single key without also depressing at least one or more of the adjacent keys. It is an important characteristic of the invention, which will be explained below, to provide a means for selectively producing a single sound no matter how many consecutive or contiguous keys are depressed.

A musical instrument includes both the linear keyboard, as well as a sound producing means which is coupled to the keyboard, for normally producing a different sound in response to activation (or depression) of each different key on the keyboard. The musical instrument, in contrast to some, has the ability to provide a one to one correspondence between keys depressed and sounds produced such that, for example, simultaneous depression of two keys (normally) produces the sound which is the result of the superposition of the two sounds that would have been produced by depression of the corresponding keys individually. In some embodiments of the invention, and particularly in the linear continuous keyboard, however, since a multiplicity of keys is necessarily depressed simultaneously by each finger, the sound producing means includes a command apparatus to select a particular one of each plurality of immediately adjacent keys simultaneously depressed by each finger, and only the sounds corresponding to the selected keys are actually produced. The particular key which is selected can for instance be the one at the center of the plurality of adjacent keys simultaneously depressed.

In all forms of the invention, the keys of the keyboard maintain the above-mentioned relationship with the intervals between the sounds they produce.

Prior art musical instruments can, for discussion, be divided into two groups, one in which the different sounds which can be produced are quantized, and other instruments in which no such limitation exists. Examples of quantized instruments are piano, organ, flute, etc., whereas examples of nonquantized instruments are the violin, cello, viola, etc. In the latter class of instruments, the number of different sounds which can be produced is theoretically infinite, within a fixed range, whereas in the quantized instrument there are only a fixed number of sounds which can be produced.

Although all embodiment of the invention are actually quantized instruments, since all of them have a fixed number of keys, the capacity of linear continuous keyboard is equivalent to that of the non-quantized class of instruments. This is for the reason that the number of keys within each octave is increased so dramatically so as to approach or exceed the point at which the different sounds produced by adjacent keys can actually be resolved by the listener. Since the continuous keyboard can produce a "continuous" set of sounds, it should be obvious that it can give the tones of any desired Politone as well as perform portamento and vibrato.

As was described with respect to the prior art, it can be difficult to locate tones in a continuous instrument when the intervals among them are not familiar to us. To overcome this, the command apparatus of the linear continuous keyboard includes means to occasionally change the one to one correspondence between keys and sounds into a many to one correspondence as follows.

In all of the forms of the invention which have been described to this point, each keyboard may be divided conceptually into a number of zones, each zone corresponding to a unique sound. In the embodiments so far described, each zone corresponds to and is represented by a different key. However, in the case of the continuous keyboard, it is possible to establish a many to one correspondence between keys and sounds so that each zone may actually encompass a plurality of keys. For example, if an unfamiliar Politone is chosen of say 27 sounds per octave, it is possible to divide the span of each octave on the keyboard into 27 zones, each zone encompassing many keys so that the depression of any (or each) key within a zone produces the same sound. In other words, it is possible to establish a one to one correspondence between the 27 zones and the 27 desired tones. Since the width of each zone is proportional to the size of the interval between the sounds produced by the zone and the following adjacent one, the keyboard, so divided, not only provides the tones of the desired politone, but is also a representative visual display of the size of the intervals among them. By this division, the keyboard makes the size of the interval between the sounds produced by consecutive keys evident to the eye as well as to the ear. Once the operator has become familiar with the new tones, the normal correspondence between keys and sounds can be restored to provide apparatus for performing vibrato and portamento.

As described above, different systems of music (great perfect, equal tempered, diatonic, etc.) use a different number of tones per octave along with a specific distribution of those tones within an octave. It is one of the important advantages of the invention that the linear keyboard can readily reproduce music in more than one Politone. In particular, the linear continuous keyboard can readily be used to produce music in any desired Politone. In order to assist in the convenience of playing music in a given Politone, I employ an apparatus for selectively distinguishing certain keys from certain other keys; the keyboard can be, for example, arranged to distinguish the set of keys which produced the tones used in the diatonic system at one time, and at another time, distinguish the set of keys which can produce the tones of a different system. One type of such distinguishing means is implemented by providing the different keys in the keyboard with a selective light source so that, at will, selected keys can be illuminated and others not illuminated. Since the distinguishing means is selective, it can be employed to highlight any desired set of keys in the keyboard in order to serve educational, technical and creative purposes.

Thus in one form of the invention, the command apparatus is able to alter occasionally the one to one correspondence between keys and sounds and establish instead a one to one correspondence between zones in the keyboard and sounds (each zone encompassing many keys), in this form of the invention, the above-mentioned apparatus is also able to selectively distinguish zones (or plural contiguous keys) on the keyboard with the aid of a translation table. Thus, for instance, in the linear continuous keyboard the apparatus can be readily configured to distinguish the proper zones to be used for playing in, for example, the diatonic music system at one time, and at a later time, the proper zones to be used for playing a particular microtonal Chinese music.

Accordingly, in one form of the invention, an improved musical instrument is provided including a keyboard with a plurality of keys arranged in a planar surface, all said keys of equal length, arranged parallel to one another, different keys corresponding to and selecting different sounds for production, groups of said keys corresponding to different octaves, each of said groups including an identical number of keys, the distance from a reference point on a key to the next being proportional to the logarithm of the interval between the sounds which these keys produce.

In another form of the invention, an improved musical instrument is provided which includes a keyboard comprising a plurality of keys arranged in a planar surface, all said keys of equal length and arranged parallel to one another, different keys corresponding to different sounds, groups of said keys corresponding to different octaves, each of said groups including an identical number of keys, said number significantly larger than 12; and command means responsive to simultaneous activation of a plurality of contiguous keys for commanding production of a single sound selected in relation to said contiguous keys.

A particular embodiment of the aforementioned device is one in which said command means includes a mode dependent translation table correlating keys and sounds, said table including at least one mode in which each key corresponds to a unique sound, and at least one other mode in which a plurality of keys correspond to an identical sound, and operator actuated mode selection means to enable a selected one of said modes of said mode dependent translation table.

It should be clear from the foregoing that the linear continuous embodiment has the advantage over existent instruments in that it is flexible enough to allow convenient use in different musical contexts, switching with ease among Politones of different cultures and epochs; this characteristic makes the instrument particularly valuable for composers as well as for teaching and learning the history of music, musicology, ethnomusicology and paleomusicology.

The use of the Cartesian notation with the improved instrument employing the linear keyboard provides a simple and clear relationship between the keyboard and the notation: for each interline in the score corresponds to a zone (or a key) on the keyboard; additional points of reference correlating notation to instrument includes shading one or more interlines in the score and highlighting or distinguishing the corresponding key or keys on the keyboard.

It should be apparent that the use of Cartesian notation along with the improved instrument provides a method of representing and producing sound whose unique and novel characteristic is the correspondence between the logarithmic representation of frequency or pitch (along the pitch axis of the score), with the linear order of the keys whose widths are also proportional to the logarithm of the pitch interval between the sounds those keys produce.

The ready correlation between score and instrument encourages self-instruction, group participation and dramatically reduces the time necessary to acquire the level of skill at which music of aesthetic and theoretical interest can be performed.

Although in all forms of the invention, the keyboard can be mechanically implemented (with or without electrical switching devices), preferred embodiments, particularly of the linear continuous keyboard, are implemented with electronic or opto-electronic devices.

BRIEF DESCRIPTION OF THE DRAWINGS

The present invention will now be further described in the following portions of the specification so as to enable those skilled in the art to practice the same when taken in conjunction with the attached drawings in which like reference characters identify identical apparatus and in which:

FIG. 11 is a table relating keys and tones under different operating modes of the instrument.

FIGS 12 and 13 are useful in describing the notation and the correspondence to traditional major scales;

FIG. 14 illustrates an improved notation and corresponding traditional notation;

FIGS. 15A and 15B illustrate a correlation between keyboard and notation; and

DETAILED DESCRIPTION OF PREFERRED EMBODIMENTS

Figure 1A:
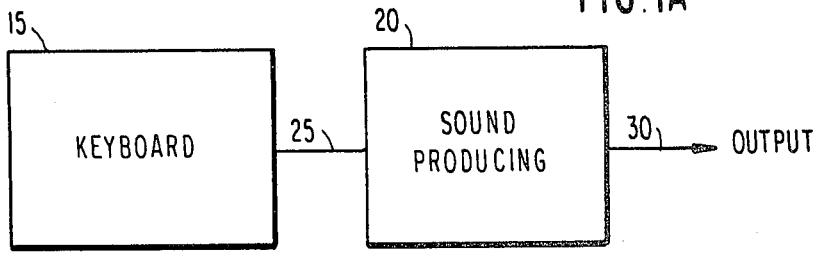
FIG. 1A is a block diagram of an improved musical instrument in accordance with the present invention.

FIG. 1A is a general block diagram of an improved musical instrument in accordance with the invention. As shown in FIG. 1A the improved musical instrument includes at least two components, a keyboard 15 and a sound producing device 20. The keyboard 15 allows an operator to select a sound or sounds for production, the keyboard 15 is coupled to the sound producing device 20 via a coupling device 25. Finally, the sounds produced by the sound producing device 20, are coupled via an output 30. The block diagram of FIG. 1A should not be construed as restricting the musical device of the invention to be one based on the operation or inclusion of electrical devices, although musical devices incorporating such components are within the scope of the invention. Rather, the tone producing device 20 could be an array of vibrating strings (such as in a conventional piano) with the device 25 coupling different keys of the keyboard 15 to different ones of the strings, so that as a key is depressed a selected one of the strings vibrates. Musical devices according to the invention could also be operated pneumatically, the tone producing device 20 could include a series of vibrating reeds and a source of air under pressure. The coupling device 25, in this case, may be a series of valves interconnecting the source of air under pressure to the reeds in such a way that when a particular key is depressed a particular one of the series of valves is opened to allow the air under pressure to flow across a selected one of the reeds. In addition, the tone producing device 20 may also use analog or digital electronic processing for producing a selected tone, as is well within the skill of the art.

Linear Basic Keyboard

Figure 2:
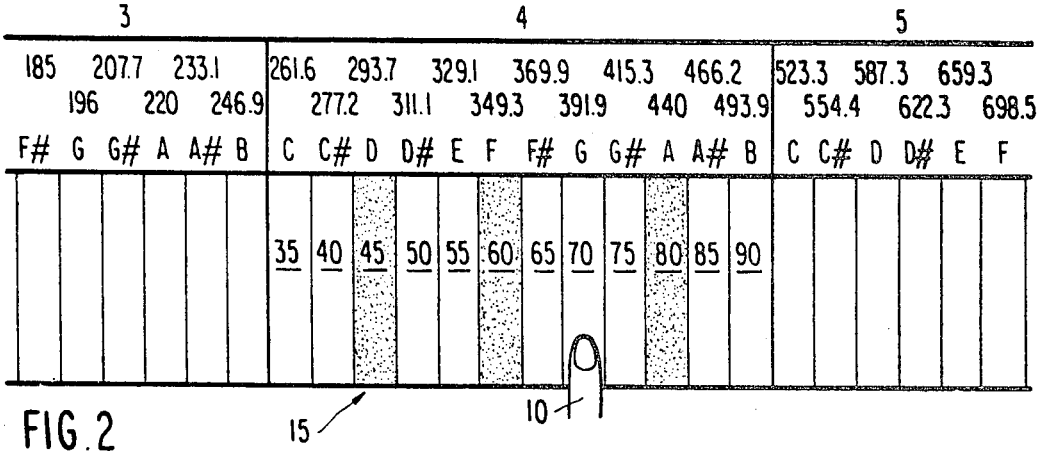
FIG. 2 illustrates a portion of an improved keyboard 15 in accordance with the present invention identifying not only the keyboard layout, but as well the different designations and tones produced when the associated key is depressed.

FIG. 2 illustrates a portion of the improved keyboard 15, in accordance with the invention. FIG. 2 illustrates that portion of the keyboard 15 which encompasses a single octave, as well as selected keys of adjacent upper and lower octaves. As shown in FIG. 2, the keyboard 15, for the illustrated octave, includes keys 35, 40, 45, 50, 55, 60, 65, 70, 75, 80, 85 and 90, for a total of 12 different keys. In FIG. 2, illustrated adjacent to but above each of the keys are an alphabetic designation of the tone produced by the sound producing device 20 when the associated key is actuated or depressed, along with a numerical designation of the frequency of the tone so produced. It is an important characteristic of the invention that each of the keys within the illustrated octave are similar and arranged side by side in a linear progression and are of identical length. Since FIG. 2 is a plan view, it does not show that the keys are in a planar arrangement, i.e. the upper surfaces of all keys lie in a theoretical plane. The width of the keys is of course related to the distance between like points on adjacent keys. That distance is selected proportional to the logarithm of the interval between the sounds produced by the keys. For equal intervals the keys are of equal width. In this fashion, the visual impression given by the keyboard tracks with the aural impression produced by activating the keys. The particular frequencies shown for the different tones in FIG. 2 are illustrative only, although they do represent traditional frequencies of the different tones of equal temperament. To facilitate correlating the keyboard 15 of FIG. 2 and the conventional piano keyboard, the alphabetic designation used in FIG. 2 is traditional. However, since each key is independent and identical to the others, then there is no longer any reason to use relativistic tone identification, e.g. sharp or flat. Accordingly, a keyboard 15 in accordance with the invention has a series of similar keys arranged in a plane, in a linear side by side order as shown in FIG. 2, for each octave on the keyboard. Although not illustrated in FIG. 2 the typical octave shown occupies a width on the keyboard which is substantially equivalent to the width of an octave occupied on a piano keyboard. As mentioned above, the number of keys within the octave (12) is, while a preferred embodiment of the invention, not the only embodiment. For example, the embodiment shown in FIG. 17 has 7 keys per octave. In other embodiments the number of keys in an octave may be increased above 12. However, because of the restraint on the span which each octave occupies on the keyboard, as the number of keys is increased above 12, the width of each keys necessarily decreases. Accordingly, there is an upper limit to the number of keys encompassed within an octave, which is determined by the ratio of the octave span in inches divided by the minimum key width, in inches, which can be depressed without necessarily depressing either adjacent key. Thus, the linear basic keyboard has an upper limit for the number of keys per octave.

In one form of the keyboard shown in FIG. 2 physical movement of the keyboard, caused by operator's depression of a key is translated into movement of a connecting arm to induce vibrations into a string, each key corresponding to a different string, the length of the string determining the frequency of vibrations and the tone of the sound so produced. In another form of the invention the mechanical movement of a key results in opening of a selected valve allowing compressed air to vibrate a reed, which determines the sound or tone so produced.

In a preferred embodiment of the invention, however, each key is associated with a pair of conductors, and for each pair of conductors a capacity measuring device responds to a change in capacitance between the conductors. The change in capacitance is produced by the presence of the operator's finger. Change in capacitance of a pair of conductors identifies the particular tone to be produced. Conventional tone producing analog or digital processing circuitry is then employed to produce the selected tone. Alternatively, each key is associated with an electric, magnetic or optical switch to alter the potential or impedance on a conductor or of a conductor pair to identify depression of a key.

In view of the preceding discussion it should be apparent that each key is permanently associated with a particular sound or tone, which is produced when the key is pressed. If more than one key is pressed simultaneously, the resulting tone is a superposition of the tones that are produced when each key is individually pressed.

As described in my copending application (which is incorporated herein by this reference), each of the keys may be selectively distinguished based on a number of different criteria. This distinguishing can be via removable inserts or the like or preferably is via selective illumination. Less preferable is permanent distinguishing such as via bumps or ridges molded into the keys. In one mode of operation for instance, a particular scale is selected, and each of the keys associated with sounds or tones in the scale is illuminated for the operator's benefit.

Figure 1B:
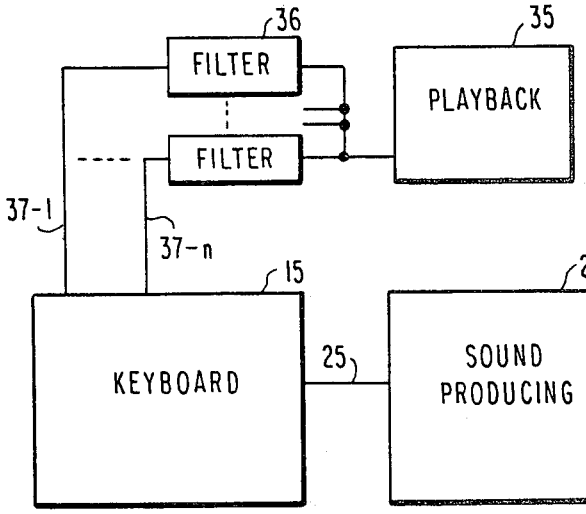
FIG. 1B is a block diagram illustrating apparatus for selective distinguishment of certain keys.

In another mode of operation a recording (magnetic tape or disc) includes a recorded signal identifying a sequence of keys, when the recording is played back the sequence of keys thus identified by the recorded signal is illuminated in the sequence of the signal read as played back. The operator can produce a musical piece corresponding to the recorded signal by merely depressing the keys in the order and for the duration in which they are illuminated. See FIG. 1B which shows the keyboard 15 and tone producing device 20. A record playback device 35 (tape, disk or card playback which can be magnetic, optical or mechanical) provides output signals representative of the record to a set of filters 36, each tuned to a different frequency. When a signal has a frequency corresponding to a particular tone, the associated filter 36 produces an output signal. Each filter 36 has an output conductor 37-1 to 37-n which is connected to a distinguishing means, such as that shown in the cited application. In this fashion, a particular recorded frequency is translated into illuminating a particular key. In this fashion, different keys can be illuminated in any selected sequence for any desired duration. Those skilled in the art will recognize that the format of the recording can be of any of a variety of conventional formats without departing from the scope of the invention, for instance, digital vs. the analog format described above. In addition, the recorded signals need not continuously identify illuminated keys, rather the signal need only identify the key and a change in state, i.e. illuminate key x, terminate illumination of key x, etc.

Distinguishing keys can be used for many purposes. It can be used to display the tones of a particular piece in which case the piece is "played" if the operator depresses each illuminated key for the duration and at the time it is illuminated. On the other hand, certain keys can be illuminated to illustrate the scale of the piece in which case the operator must still select, on some other basis, the keys to be depressed in order to play a piece.

Figure 1C:
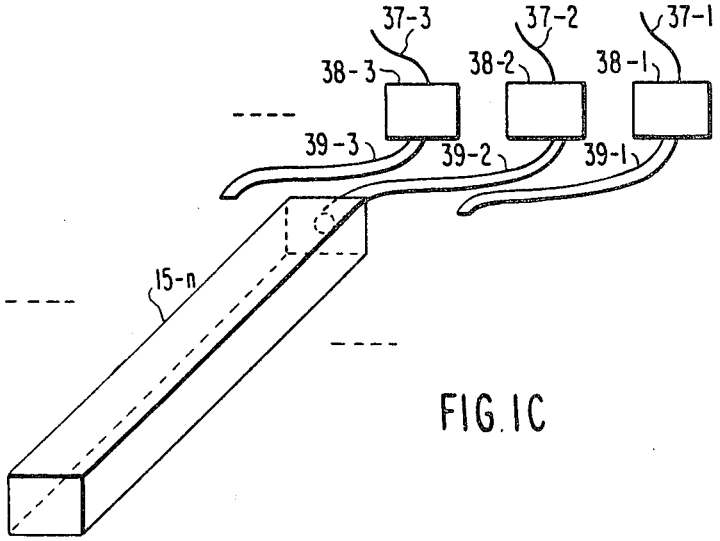
FIG. 1C shows the distinguishing means of a typical key.

FIG. 1C illustrates one form of apparatus to provide for selective distinguishment or illumination. As shown, a typical key 15-n is translucent and coupled to a selected light pipe (fiber optic) 39-1 to 39-n, one light pipe per key. Light is selectively applied to the light pipe by an associated lamp (LED) 38-1 to 38-n. The LED's are selectively illuminated by signals over conductors 37-1 to 37-n.

Now that the manner of operation of the instrument has been explained, reference is made to FIGS. 2, 14, 15A and 15B for the purpose of describing the manner in which a musical score in the new notation can be used to operate the instrument or the keyboard 15 shown in FIG. 2. FIG. 14 shows, at the top, a short piece in traditional notation, and located below is the identical music in the Cartesian notation. Some of the interlines in FIG. 14 carries a reference character which is the primed counterpart of the reference character identifying the key in FIG. 2. This graphically illustrates the correlation between each interline in the score and each key on the keyboard. Furthermore, for the purpose of providing the operator with several points of reference within the octave, three of the interlines in FIG. 14 are shaded, e.g. 45', 60' and 80'. The distinguishing means of the invention can be employed to selectively illuminate the corresponding keys, e.g. 45, 60 and 80. It should be clear that a novel characteristic of the method is the correspondence between the logarithmic representation of pitch (along the pitch axis of the score) with the linear order of the keys whose widths are also proportional to the logarithm of the pitch interval between the sounds produced thereby.

Figure 15B:
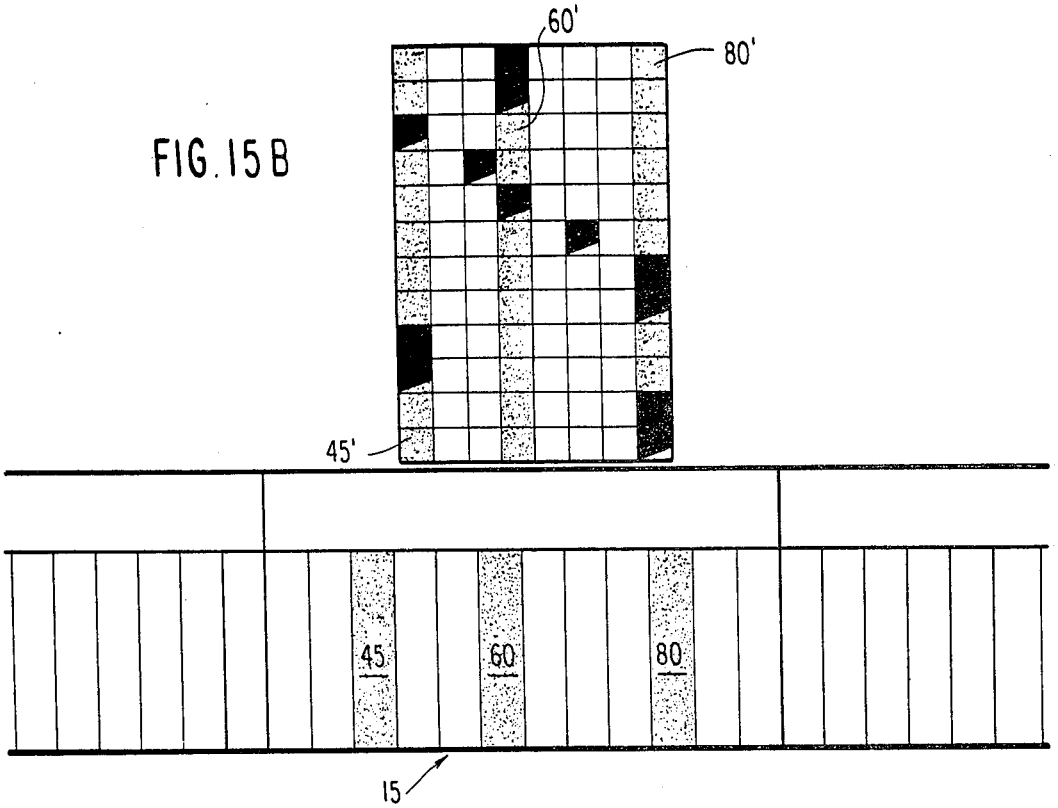
Figure 17:
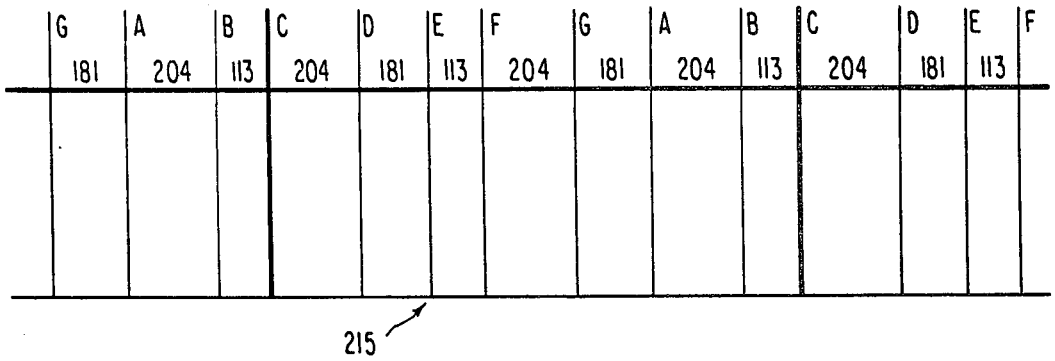
Figure 18:
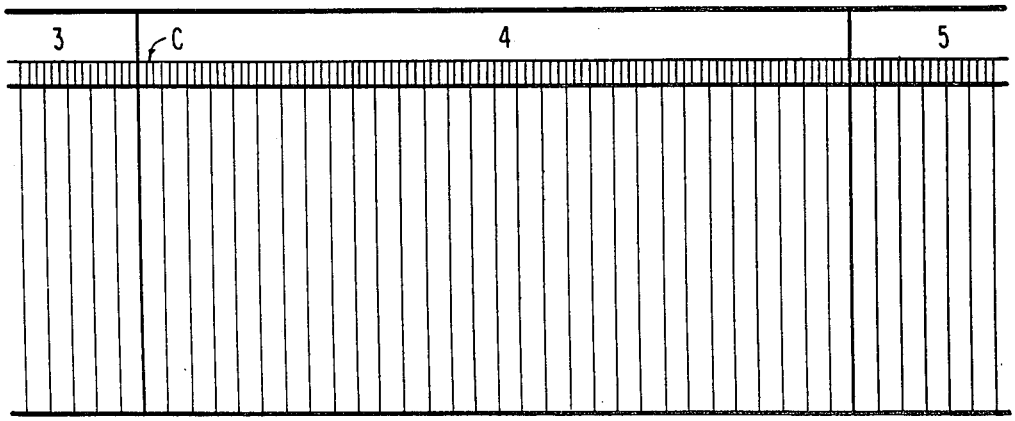
FIG. 18 illustrates an improved linear keyboard with 30 keys within each octave. This keyboard is an example of the embodiment which I term Linear Microtonal Keyboard.

In order to play the score, the operator depresses the keys corresponding to each trapezium in the sequence in which the trapeziums are located in the score and for the duration represented by their size. FIGS. 15A and 15B illustrate that the music can be oriented in two differing relations to the keyboard 15, in one orientation (FIG. 15B) the correlation between interlines and keys is especially clear. As mentioned above the distance between reference points of two adjacent keys is proportional to the logarithm of the interval between the sounds produced by the keys. In FIG. 2 the intervals are all equal and so the keys are of identical width. FIG. 17 shows a different keyboard 215 arranged with seven unequal intervals per octave. As a result the width of the keys are unequal. The alphabetic designation above each of the keys identifies the sound of the key and the numerical designation identifies the interval between the sound of the key and the sound of the adjacent key with a sound of higher frequency.

The foregoing description of the invention is confined to a linear basic keyboard embodiment. The following portions of this application are related to a linear continuous keyboard embodiment. Whereas in the linear basic keyboard, typically sounds produced by adjacent keys may represent an interval of a semitone, or on that order, in the linear continuous keyboard the interval between sounds two adjacent keys are able to produce is small enough to provoke the illusion of producing a continuous set of sounds via the keyboard. The actual size of this interval is merely a matter of cost, decreasing the interval raises the cost. The smaller the interval the smaller the width of the key is so as to encompass the interval of an octave in the same space as the piano keyboard and the linear keyboard. Just as in the linear basic keyboard, the sound produced by each key of the linear continuous keyboard (in one mode) is definite and different from the sound that the other keys produce when pressed. Although the description omits any discussion of the correspondence between notation and the keyboard, it should be apparent that the same correlation is present. Furthermore other embodiments of the invention (with or without the command apparatus) may have a number of keys greater than the linear basic keyboard but less than the linear continuous keyboard. A specific embodiment which I term Linear Microtonal Keyboard has a number of keys greater than 12 but fewer than the number required to produce the illusion of producing a continuous set of sounds.

Linear Continuous Keyboard

Figure 3:
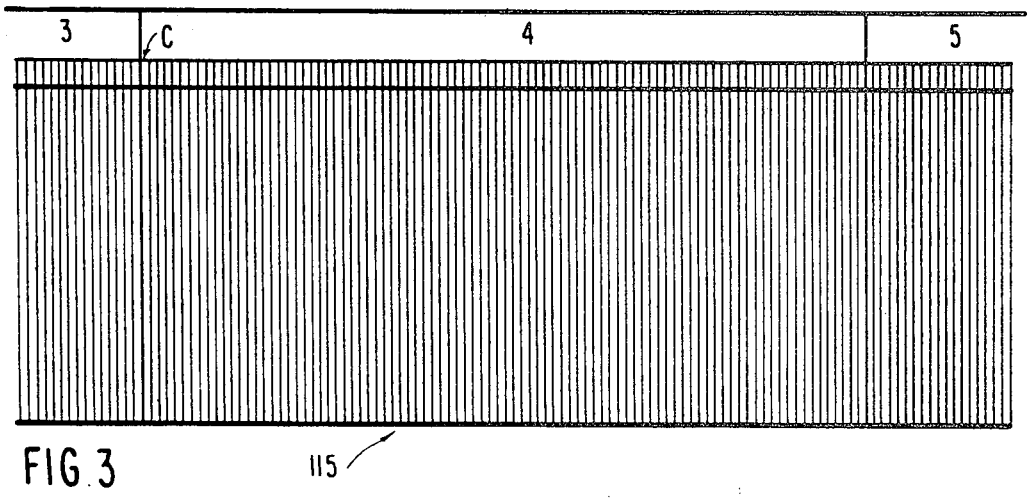
FIG. 3 illustrates a different improved keyboard and FIGS. 4 and 5 are useful in explaining the operating characteristics of this keyboard.
Figure 4:
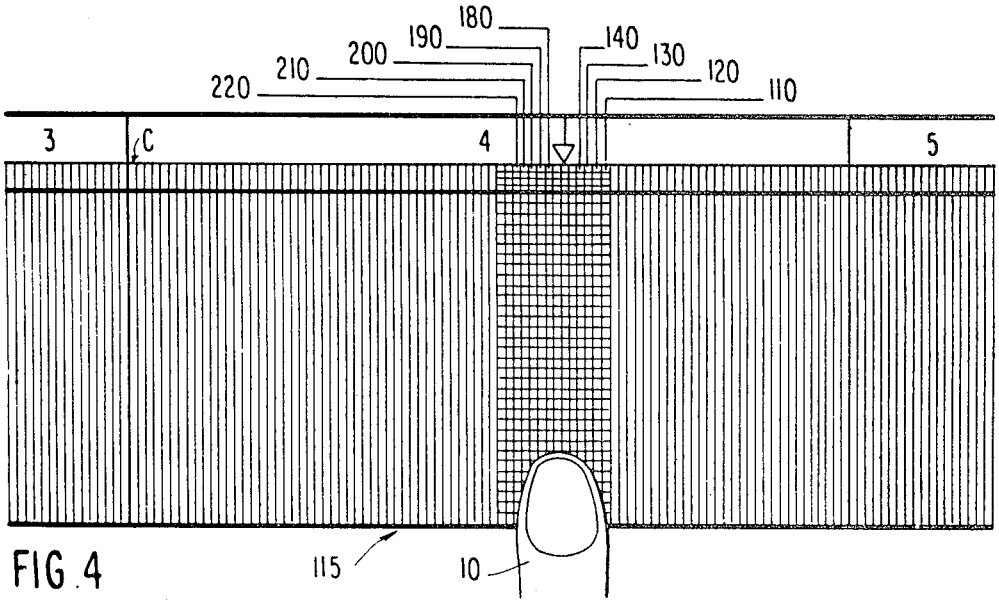

A representation of a linear continuous keyboard is shown for example in FIG. 3. FIG. 3 shows a portion of a keyboard 115 in accordance with the linear continuous keyboard embodiment of the invention. The portion of the keyboard 115 illustrated in FIG. 3 occupies the same octave which is illustrated in FIG. 2 except that now instead of providing 12 different keys within this octave there are approximately 90 or more different keys within the octave. Since the frequency range of the octave is unchanged, the interval between adjacent keys is much smaller than in the linear keyboard embodiment. While a continuous keyboard with approximately 90 keys per octave is illustrated in FIG. 3, the particular number of keys within an octave is exemplary, and it can actually be varied within quite wide limits. It should also be apparent that the various mechanical and/or electronic devices that can be used to implement the keyboard of FIG. 3 may use entirely similar principles to those used to implement the keyboard of FIG. 2. There is, however, a significant difference in operating the keyboard of FIG. 3 as compared to operating the keyboard of FIG. 2. Because the width of the different keys in the keyboard of FIG. 3 is so much smaller, an operator's selection of a particular key is hampered by the very width of the operator's finger. As shown in FIG. 4, it is impossible (without some auxiliary apparatus) to depress a single key without simultaneously depressing keys adjacent the intended key. More particularly, FIG. 4 illustrates the same portion of the keyboard 115 illustrated in FIG. 3, and in addition illustrates an operator's finger 10 depressing a plurality of keys 110–220, which are shown shaded. Clearly the operator intends only the production of a single tone, but it is the physical impossibility for the operator's finger 10 to select a single key which is causing a plurality of keys to be depressed. To maintain the characteristics of the improved musical instrument, it includes the ability to determine, when a plurality of adjacent or contiguous keys are all simultaneously depressed, to identify a selected key in the group (i.e., the key lying in the center), and only that corresponding tone is produced. Those skilled in the art will readily perceive how this can be accomplished using digital processing techniques. Accordingly, although the operator has depressed keys identified in FIG. 4 as 110 through 220 through the previously described techniques only the tone corresponding to key 160 is actually produced.

This provides the improved musical instrument with a significant vibrato producing technique. This is illustrated in FIG. 5, which again shows the identical portion of the keyboard 115, but now shows the operator's finger 10 in two positions, one shown solid and the other shown dotted. With the operator's finger 10 in the solid position, the center key is the key identified by the arrow A, whereas the operator's finger is in the dotted position, the center key is the key identified by the arrow labeled B. Since these two positions are closely adjacent, the operator can move from position 1 to position 2 by simply rolling the operator's finger along the keyboard. By effecting oscillatory motion between the solid and dotted position, by rolling a finger back and forth, the sounds corresponding to keys A and B are produced alternately in sequence, producing a vibrato effect. Furthermore, since the rolling action is continuous, each of the tones between A and B are produced, in turn, as the operator's finger moves between the solid and dotted position.

Figure 5:
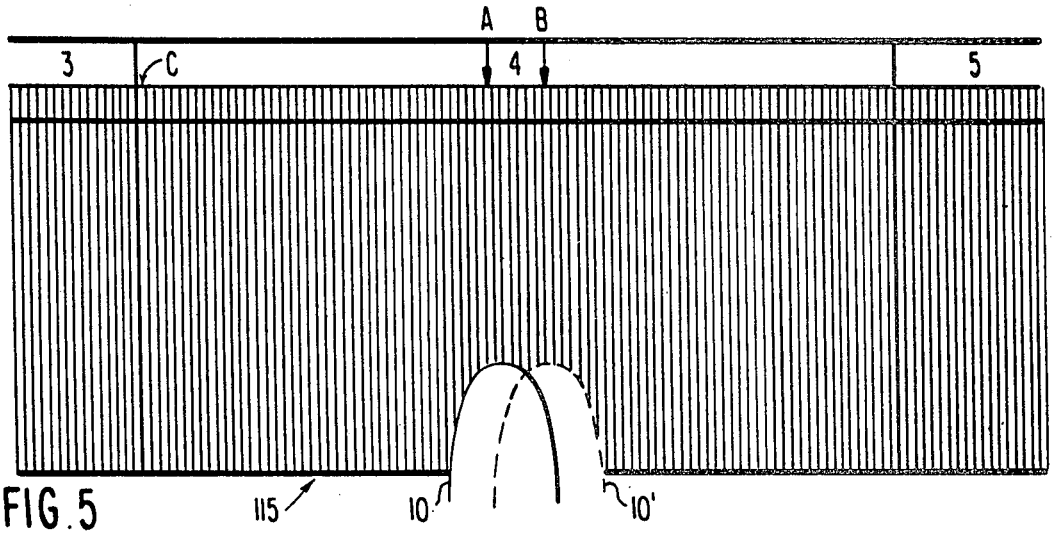
Figure 6:
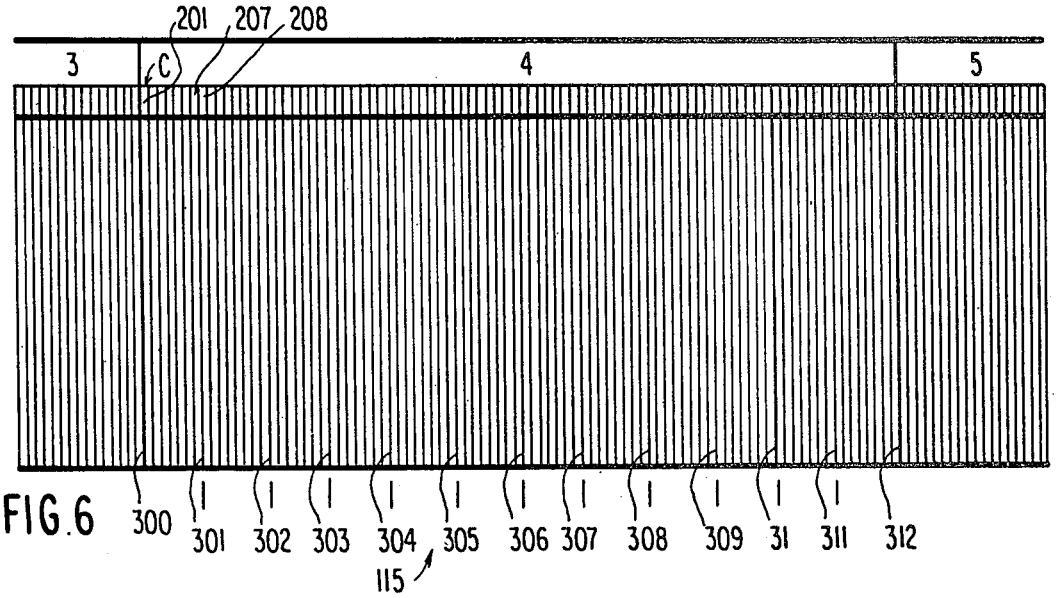
FIGS. 6, 7 and 17 illustrate embodiments of the improved keyboard which distinguish major zones to assist the operator.
Figure 7:
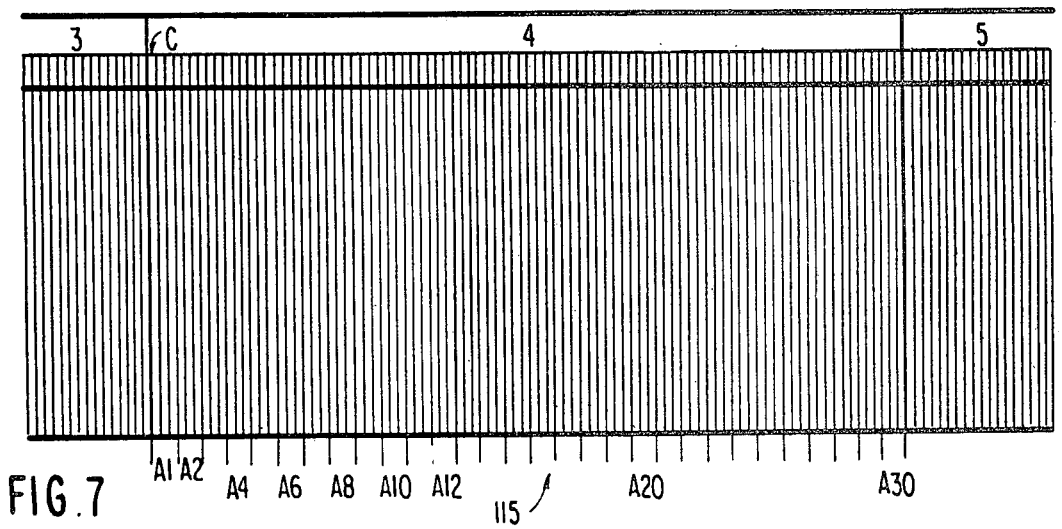

FIG. 6 shows a similar portion of a continuous keyboard 115 which is similar to the portion of the continuous keyboard shown in FIGS. 4 and 5. The keyboard 115 may have, as was the case with FIGS. 4 and 5, approximately 90 keys per octave. Some of the keys are identified with the reference characters 201–208, others are not numbered for convenience. In addition, as shown in FIG. 6 there are a number of major divisions, between groups of keys such as major divisions 300 and 301, encompassing between them the keys identified with reference characters 201–207. Similarly, the major divisions 301 and 302 encompass keys 208–215, and so on. For the octave pictured in FIG. 6 there are 13 major divisions 300–312, identifying 12 major intervals. Those skilled in the art will recognize that the 12 major intervals in the octave corresponds to the 12 tones of the Equal Temperament. The major divisions 300–313 are conceptual but they can be represented by a distinguishing characteristic of the particular keys adjacent thereto, e.g., keys 201 and 208. The major divisions thus enable the operator to more readily identify the traditional 12 tones per octave. However, since each octave includes the exemplary 90 keys, the vibrato and other effects are still available as with the keyboards shown in FIGS. 4 and 5. FIG. 7 is an illustration of a similar keyboard 115 except that now instead of illustrating 12 major intervals in an octave, 30 major intervals are illustrated in the octave, those intervals identified A1–A30. Otherwise, the representations in FIGS. 6 and 7 are identical.

In another embodiment of the invention the major intervals (for instance the 12 intervals of FIG. 6 per octave or the 30 intervals of FIG. 7 per octave) can take on different significance. It may sometimes be desirable for the improved musical instrument of the present invention to take on the characteristics of the continuous keyboard (e.g., a large number of different keys or tones per octave—90 or more for example) and at other times to take on the characteristics more similar to the linear basic keyboard (e.g., the traditional 12 tones per octave). This is easily provided through the digital processing of a conventional microprocessor. With such characteristics, and referring to FIG. 6 again, in a first mode of operation, depressing any key produces the sound associated with that key. In a second mode of operation, the depression of any key within a given zone produces the identical sound, which is not necessarily the sound normally associated with the key. A zone may be defined as lying between divisions 300 and 301. This zone may be distinguished in a number of ways. Each key (201–207) in the zone may be illuminated. The keys at the end of the zone (201, 208) may be illuminated. The key in the center (204) may be illuminated. As an example, let us assume that the machine is operating in the second mode and the operator depresses key 201. Rather than producing the tone of the key 201, the instrument may produce some other tone, e.g., the tone associated with key 204, or some other key within the zone. For example, each key in any zone, in the second mode when depressed produces the tone of that key which is most nearly in the center of the zone. To see how this is effected reference is now made to FIG. 8. While the zones may be arranged in equal tempered fashion as shown in FIG. 6 that is not essential. The different zones could take the form of FIG. 17, for example.

Figure 8:
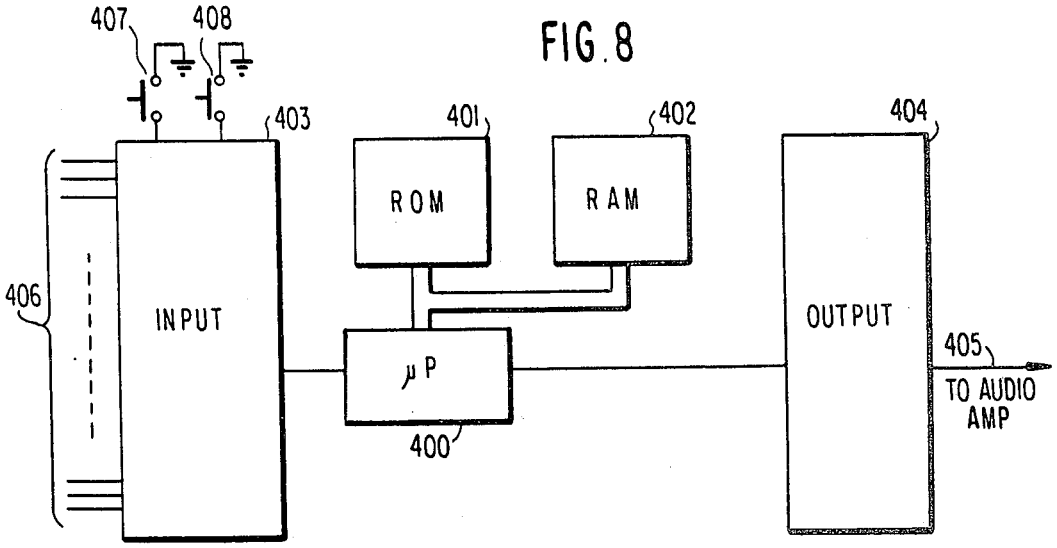
FIG. 8 is a detailed block diagram of the keyboard interface and tone producing portion of the improved musical instrument in one embodiment.

FIG. 8 is a block diagram of the tone producing device 20 of the improved musical instrument and the interface to the keyboard. As shown in FIG. 8 this apparatus includes a microprocessor 400 including ROM401 and RAM402, and input device 403 and an output device 404. The input device 403 couples a signal to the microprocessor 400 identifying, in coded form for example, the identity of every key which has been depressed. The microprocessor 400 processes key identity to produce a signal on its output, coupled to the output device 404 which will produce the tone associated with the key or keys depressed to be amplified for example by an audio amplifier. Devices to perform the foregoing function are conventional in the art. In order to implement this operation the keyboard may include an electrical switch for each key, with an associated conductor coupled to the input device 403. Accordingly, and as shown in FIG. 8 a plurality of conductors 406 are coupled to the input device 403. A signal on the conductor may identify when the corresponding key has been depressed, the signal for example could be a change in voltage or impedance.

Figure 9:
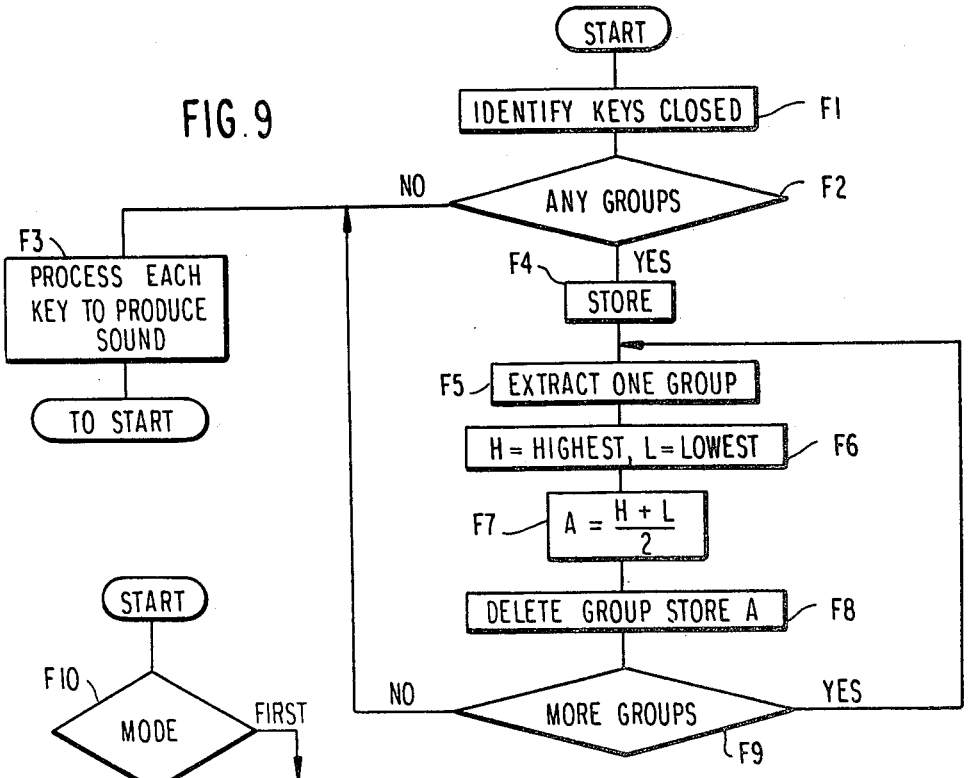
FIGS. 9 and 10 are flow diagrams of the portion of the processing routines carried out by the device of FIG. 8.

FIG. 9 is a flow diagram for a part of the processing routine carried out by the microprocessor 400 to effect the function shown in FIGS. 4 and 5, e.g., selecting a key (or the tone associated with that key) which is in the center of a contiguous group of keys which are simultaneously depressed. This command function of the processor 400 can be considered part of the keyboard or keyboard interface function rather than part of the sound producing function. The processing relies on the fact that when a plurality of contiguous keys are depressed, the operator intends the tone to be produced which is associated with one of the keys in the group. Accordingly, function F1 identifies the keys which have been closed or depressed. Function F2 examines the identification to determine if there are any groups, e.g., a plurality of contiguous keys depressed, such a plurality is defined as a group. If there are no such groups than function F3 processes each of the identified keys to produce the corresponding tone. On the other hand, if there are one or more such groups, function F4 stores the identification of the depressed keys in groups. Function F5 extracts the identification of one group, and function F6 sets the parameters H and L to the highest and lowest keys in the group. Function F7 computes the parameter A as shown. Function F8 then deletes the identification of the group and in its place stores the identification of the single key with the identification A. Function F9 then determines if there are any additional groups to be processed, and if so processing loops back to function F5. If all groups have been processed, then the processing skips to function F3. So long as the keys are identified with numerical identifications in sequential order, the algorithm of function F7 in effect computes the average of the keys to thus identify that key which is in the center of a group of keys which have been depressed.

I will now explain how a second mode of operation can be implemented. As shown in FIG. 8, the input device 403 also includes a pair of additional switches 407 and 408. Switch 407 is closed when the operator desires first mode operation and switch 408 is closed when the operator desires second mode operation. The input device 403 recognizes the condition of the switches 407 and 408 and provides corresponding data to the microprocessor 400 for processing. In this embodiment, the function F1 is replaced by the functions F10 and F11; refer to FIG. 10.

Figure 10:
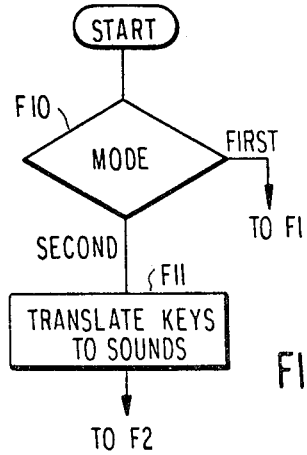

As shown in FIG. 10, function F10 determines whether the operator has selected first or second mode operation. For first mode operation, processing skips directly to function F2. On the other hand, if second mode operation had been selected, then function F11 is performed which translates the key closures to tone identification. The translation is effected as will now be described with the table shown in FIG. 11.

The table in FIG. 11 includes three columns and a row for each different key in the keyboard, each different key is identified by a key number 210–226, etc. The second column in FIG. 11 identifies the sound produced when that key is closed (in first mode) and for the keys shown in the table of FIG. 11, tones 0–26 are referenced. However, when function F11 determines second mode, then the sound produced by a particular key is not the sound identified in the second column, but rather is the sound identified in the third column. As shown then, in FIG. 11, when any of keys 210–219 are depressed the sound produced is sound 5, the sound which is produced by key 215, the key at the center of the group. Similarly when any of keys 220–226 is selected in second mode operation the sound produced is sound 25 and not any other tone. Those skilled in the art will appreciate that a particular sound produced, in second mode operation, on the depression of any key within a group is not necessarily the sound produced by the key lying at the center of the group. Furthermore, although the table of FIG. 11 identifies only the sounds for first and second mode operation, there is no reason why operation is restricted to two modes, but in fact many different modes could be provided so long as apparatus is provided to identify to the apparatus the particular mode desired by the operator and the information for translating key closures to tones in respect of a particular mode of operation is made available. This may readily be made available by storage of appropriate information in ROM401.

Accordingly, the improved musical instrument of the invention can in one mode of operation provide an instrument capable of producing many different sounds per octave (e.g., 90) while the machine can be operated in another mode in which 30 different sounds per octave are available, or it can be operated in still a different mode in which only 12 different sounds per octave are available.

As an alternative mode of operation, instead of attributing, to each key in a zone, a sound associated with the zone, the zone's sound may be attributed to only one key in a zone, and no sound or a null sound is attributed to each other key in a zone. This is shown in FIG. 11 under the ALTERNATIVE column.

Figure 16:
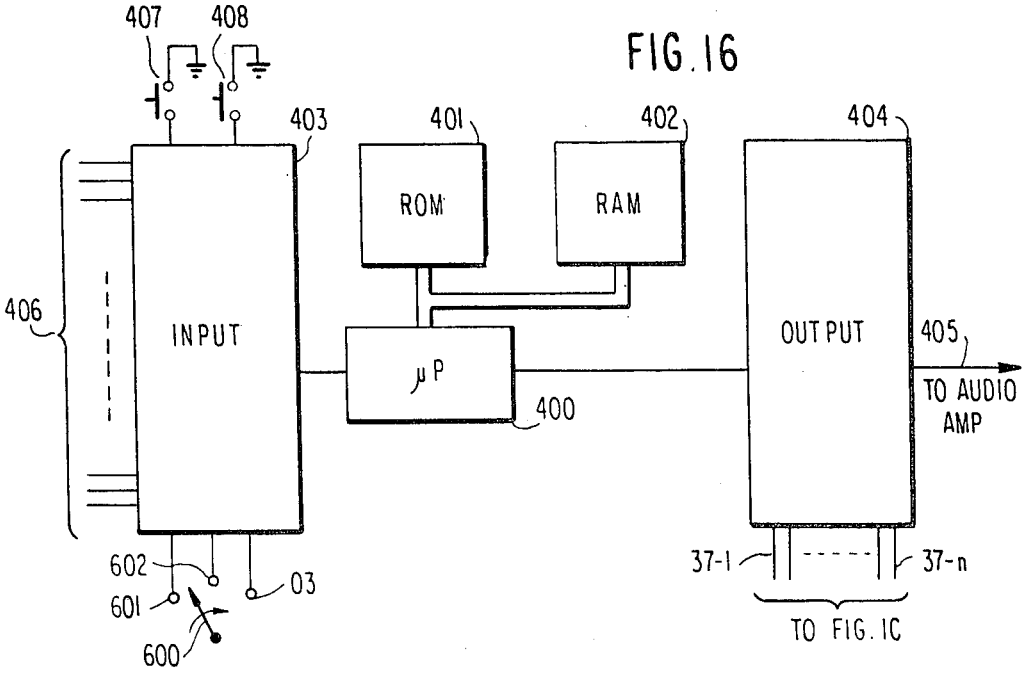
FIG. 16 shows how selection of a Politone can control both key to tone correspondence and visually display zone location and width on the keyboard.

FIG. 16 is similar to FIG. 8 except that the input interface 403 receives inputs from a multi-position switch 600 with plural contacts; in FIG. 16 contacts 601–603 are shown. The switch may be positioned to select a particular Politone, equal temperament, great perfect, etc. by appropriately positioning the switch 600. This has two effects. In the first place the ROM 401 stores a table correlating, for each available switch position, the corresponding zone identification. When a Politone is selected the ROM 401 is read and output device 404 places an appropriate pattern of energization or deenergization on the conductors 37-1 to 37-n. These are coupled to the light sources of FIG. 1C. As a result, selection of switch position produces a pattern of illuminated/non-illuminated keys on keyboard 115 to display the different zones of the Politone. At the same time, if desired, the particular switch position is also used to select the appropriate mode (the appropriate column of the Table in FIG. 11) to ensure that each key of a zone produces the same sound or pitch. In this fashion, the operator actuated switch 600 selects the correspondence between keys and tones as well as controlling the distinguishing means.

I claim:

1. An improved sound selection device for a musical instrument including a keyboard and comprising:

a plurality of keys, all said keys with an upper surface lying in a plane, of equal length and arranged parallel to one another, different keys corresponding to and selecting different sounds for production, groups of said keys corresponding to different octaves, each of said groups including an identical number of keys, said number significantly greater than 12;

command means responsive to simultaneous selection of a plurality of contiguous keys for commanding production of a single sound selected in relation to said contiguous keys.

2. The apparatus of claim 1 wherein said keys are of equal width and said number is about 48 or greater.

3. The apparatus of claim 1 or 2 in which said command means includes a mode dependent translation table correlating keys and sounds, said table including at least one mode in which each key corresponds to a unique sound and at least one other mode in which a plurality of keys correspond to an identical sound;

operator actuated mode selection means to enable a selected one of said modes of said mode dependent translation table.

4. The apparatus of claim 3 in which at least one mode in said translation table a mode in which there are plural zones per octave, wherein a key selection of any key in a zone producing an equal sound.

5. The apparatus of claim 4 in which said keyboard means includes distinguishing means for selectively distinguishing a key from other keys, and in which said distinguishing means is responsive to said operator actuated mode selection means to distinguish keys in a zone.

6. An improved musical instrument comprising keyboard means for selection of sounds and sound producing means for producing sounds in accordance with selections from said keyboard means, in which said keyboard means comprises:

a plurality of keys, all said keys with an upper surface lying in a plane, of equal length and arranged parallel to one another, different keys corresponding to different sounds, groups of said keys corresponding to different octaves, each of said groups including an identical number of keys, said number significantly larger than 12; and command means responsive to simultaneous activation of a plurality of contiguous keys for commanding production of a single sound selected in relation to said contiguous keys.

7. The device of claim 6 wherein said keys are of equal width and said number is at least 48.

8. The apparatus of claim 6 or 7 in which said command means includes a mode dependent translation table correlating keys and sounds, said table including at least one mode in which each key corresponds to a unique sound and at least one other mode in which a plurality of keys correspond to an identical sound;

operator actuated mode selection means to enable a selected one of said modes of said mode dependent translation table.

9. The apparatus of claim 8 in which at least one mode in said translation table establishes a mode in which there are plural zones per octave, wherein selection of any key in a zone produces an equal sound.

10. The apparatus of claim 9 in which said keyboard means includes distinguishing means for selectively distinguishing a key from other keys, and in which said distinguishing means is responsive to said operator actuated mode selection.

* * * * *